US006681723B1

(12) United States Patent
Amendt et al.

(10) Patent No.: US 6,681,723 B1
(45) Date of Patent: Jan. 27, 2004

(54) HOT WATER HEATER

(76) Inventors: Marvin Amendt, P.O. Box 484, Charlie Lake, British Columbia (CA), V0C 1H0; Dale MacIntosh, 2002 Oak Street, Sherwood Park, Alberta (CA), T8A 0W8

( * ) Notice: Subject to any disclaimer, the term of this patent is extended or adjusted under 35 U.S.C. 154(b) by 5 days.

(21) Appl. No.: 10/248,724

(22) Filed: Feb. 12, 2003

(51) Int. Cl.[7] ..... F22B 5/02

(52) U.S. Cl. ..... 122/18.3; 122/214; 122/216; 122/210; 122/230

(58) Field of Search ..... 122/17.1, 17.2, 122/13.01, 18.1, 18.3, 209.1, 214, 215, 216, 210, 230

(56) References Cited

U.S. PATENT DOCUMENTS

| | | | | | |
|---|---|---|---|---|---|
| 1,622,569 | A | * | 3/1927 | Birtch | 122/23 |
| 1,785,304 | A | * | 12/1930 | Ganz | 122/25 |
| 2,147,046 | A | | 2/1939 | Leoni | 122/45 |
| 2,495,673 | A | * | 1/1950 | Erwin | 122/52 |
| 2,715,390 | A | | 8/1955 | Tenney et al. | 122/24 |
| 4,398,502 | A | * | 8/1983 | Park | 122/17.2 |
| 4,449,484 | A | | 5/1984 | Sakamoto et al. | 122/13 |
| 4,541,410 | A | | 9/1985 | Jatana | 126/362 |
| 4,641,631 | A | | 2/1987 | Jatana | 126/101 |
| 4,677,939 | A | | 7/1987 | Henault et al. | 122/17 |
| 4,766,883 | A | | 8/1988 | Cameron et al. | 126/351 |
| 5,022,352 | A | | 6/1991 | Osborne et al. | 122/17 |
| 5,085,579 | A | | 2/1992 | Moore, Jr. et al. | 431/326 |
| 5,115,798 | A | | 5/1992 | Moore, Jr. et al. | 126/351 |
| 5,179,914 | A | | 1/1993 | Moore, Jr. et al. | 122/17 |
| 5,357,907 | A | | 10/1994 | Moore, Jr. et al. | 122/406 |
| 5,544,645 | A | | 8/1996 | Armijo et al. | 126/101 |
| 5,636,598 | A | | 6/1997 | Moore, Jr. | 122/17 |
| 5,735,237 | A | | 4/1998 | Phillip et al. | 122/13.1 |
| 6,036,480 | A | | 3/2000 | Hughes et al. | 431/353 |

FOREIGN PATENT DOCUMENTS

| | | |
|---|---|---|
| DE | 571 067 | 2/1933 |
| WO | WO 84/01018 | 3/1984 |
| WO | WO 00/50821 | 8/2000 |

* cited by examiner

*Primary Examiner*—Jiping Lu
(74) *Attorney, Agent, or Firm*—Bennett Jones LLP

(57) ABSTRACT

The present invention is directed to an apparatus for heating hot water. The present apparatus utilizes at least two individual hollow conduits that pass through the interior of a hot water tank. Independent inshot gas burners mounted in the conduits pass hot air through the hollow conduits warming the water surrounding the conduits. The conduits are organized in the interior of the tank in such a manner as to create distinct differential temperature zones. Each such temperature zone has an associated hot water outlet. The inshot burners are regulated to maintain the temperature zones. In this manner, the user is able to utilize the advantages of an internal coil heating system but has the ability to draw steady supplies of water of varying temperatures from the tank which is critical for many modern residential and commercial hot water and hydronic systems.

12 Claims, 2 Drawing Sheets

10
12
16
33
14A
28A
18
19
28B
14B.
21
22
20

HOT WATER HEATER

BACKGROUND OF THE INVENTION

The present invention relates to an apparatus for heating hot water.

The usual method for heating hot water for residential and commercial purposes is to use a vertically orientated cylindrical hot water tank with a convex metallic base plate. An atmospheric burner fed by an external gas or oil supply is usually positioned immediately beneath the base plate. On command, triggered by an internal thermostat, the atmospheric burner ignites. Heat from the flame of the atmospheric burner conducts through the base plate and warms the water inside the hot water tank. Hot air, products of combustion and un-burnt gases are channeled into a vertical flue which vents them into the external atmosphere. During operation flue temperatures on conventional hot water heaters can often be as high as 300° C. Conventional hot water heaters are generally supplied with cold water by means of a vertically descending feed pipe that injects cold water into the hot water tank in an area proximate to the base plate. At the top of the hot water tank is an out-take valve which removes hot water from the tank when needed. When the atmospheric burner is ignited the water at the bottom of the tank is heated and it rises to the top of the tank. When the burner is turned off, there is a convective mixing of the hot and cold water and the water temperature equalizes throughout the tank.

The disadvantages of such conventional systems are considerable. The use of an external atmospheric burner in conjunction with a metallic base plate greatly reduces heat exchange efficiency. A considerable amount of stand-by heat loss is experienced and further heat is lost through the flue system into the external atmosphere. Also, the base plate has a relatively small surface area that is in contact with the water inside the tank. The use of an external burner and flame in an enclosed room also poses obvious safety risks. Further, because the flame impinges directly on the external surface of the hot water tank, the potential to use different types of materials to construct the hot water tank is greatly restricted and removes including the ability to use high efficiency insulating materials such as composite fiberglass. Finally, a large disadvantage of conventional hot water heaters is the inability to provide consistent supplies of hot water at varying temperature ranges. Many modern residential properties utilize hydronic heating systems which require differential hot water temperature supplies. Commercial operations also often require hot water of varying temperatures. With a conventional system the hottest water is simply drawn from the top of the tank and as previously discussed, convection and mixing often result in the hot water tank containing water at one uniform temperature throughout.

There have been attempts to create hot water heaters that overcome some of these problems. Hot water heaters have been developed that utilize an internal coil system to heat the water instead of using an external atmospheric burner. Hot gas or hot liquid is forced through a hollow coil which transmits the heat into the surrounding water. The use of an internal coil system greatly raises efficiency and alleviates many of the problems encountered using an external atmospheric burner. Stand by heat loss is virtually eliminated, a far greater heating surface area is exposed to the water and the dangers associated with using an external open flame are largely addressed. Further, because the external surface of the tank is not being heated, a broadened choice of construction materials is available. However, these hot water heaters all utilize a single internal coil system, and like the prior conventional hot water heaters, they are unable to provide constant and reliable supplies of hot water of varying temperatures. Further, as with the conventional hot water heater, there will be tendency for the hot water to mix resulting in a single uniform temperature within the tank.

U.S. Pat. No. 4,203,392 teaches the use of a single heating coil with a physically divided hot water tank such that there is an upper hot tank and a lower cold tank. However, this device is capable of only supplying hot water of one temperature. Further, the separated areas cannot be exclusively heated, and they can only be heated at the same time with the single heating coil.

There is a need in the art for an efficient hot water heating apparatus that utilizes the advantages of an internal coil heating system but that has the capability of providing reliable and steady supplies of hot water of varying temperatures.

SUMMARY OF INVENTION

The present invention is directed to an apparatus for heating water.

Accordingly, in one aspect of the invention, the invention comprises a water heating apparatus comprising:

(a)a water storage tank having a cold water inlet and having at least two hot water outlets;

(b)at least two hollow heating conduits, each conduit passing into the tank from an exterior position, traveling through the interior of the tank and exiting out of the tank, wherein a first conduit is associated with a first heating zone and a second conduit is associated with a second heating zone, the heating zones being vertically stacked;

(c)each conduit having an inshot gas burner associated with the hollow conduit; and (d)means for independently turning each inshot gas burner on or off.

In a preferred embodiment the individual conduits may be helically coiled within the interior of the tank between their entry position and their exit position. The independent gas inshot burners may be regulated by at least two aquastats placed in the interior of the tank. As well, each distinct heating zone may have an associated hot water outlet. In one embodiment, the conduits may feed into a common exhaust flue containing a trap and drain to catch condensation in the exhaust gases. In one embodiment, the exhaust flue may contain a fan to draw the exhaust gases through the hollow conduits. In another embodiment, the helical coils of the individual conduits may overlap and fit together such that there may be more than one individual conduit associated with each heating zone.

BRIEF DESCRIPTION OF DRAWINGS

The invention will now be described by way of an exemplary embodiment with reference to the accompanying simplified, diagrammatic, not to scale drawings. In the drawings.

DETAILED DESCRIPTION

Figure 1:
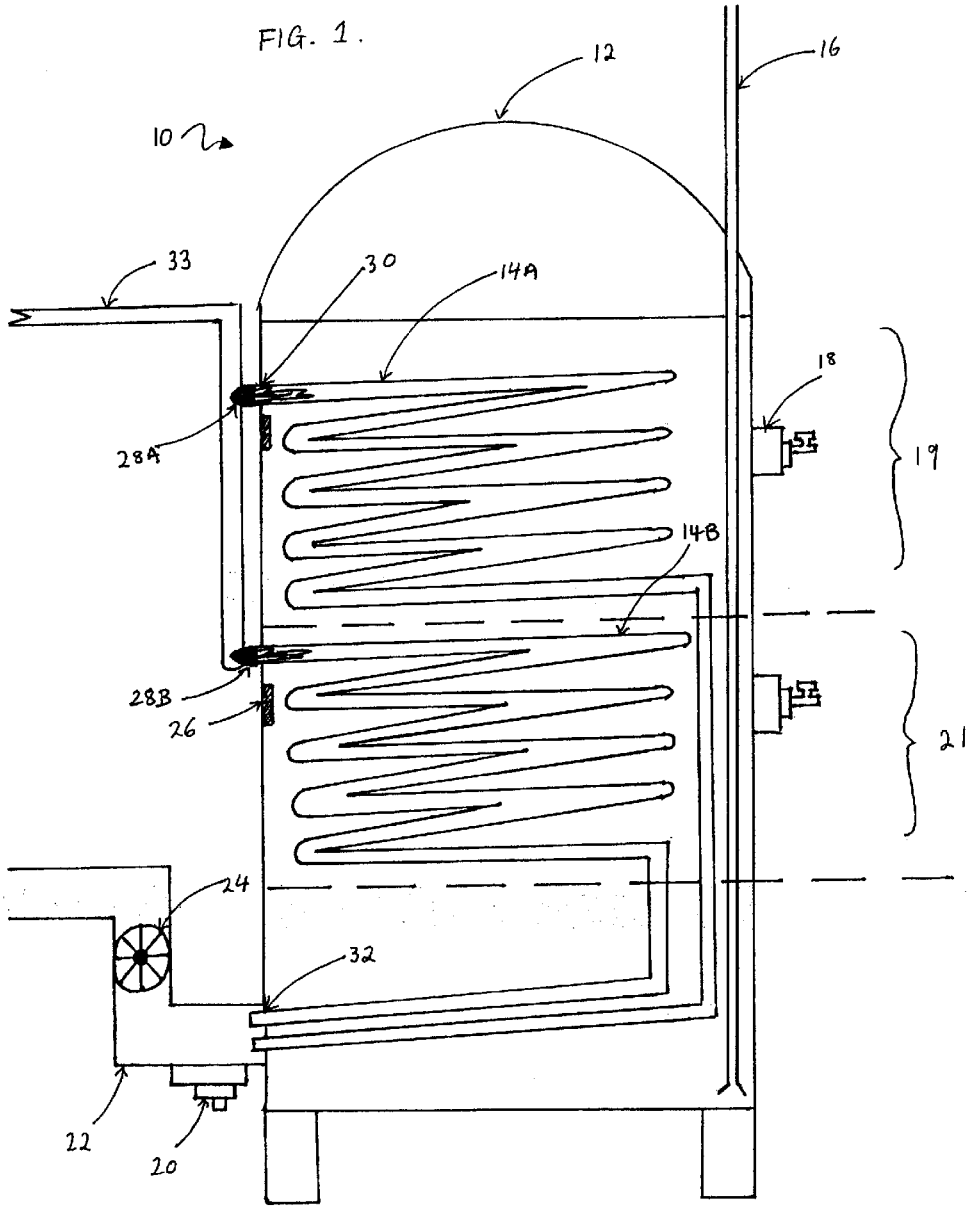
FIG. 1 is a sectional side view of one embodiment of the apparatus.
Figure 2:
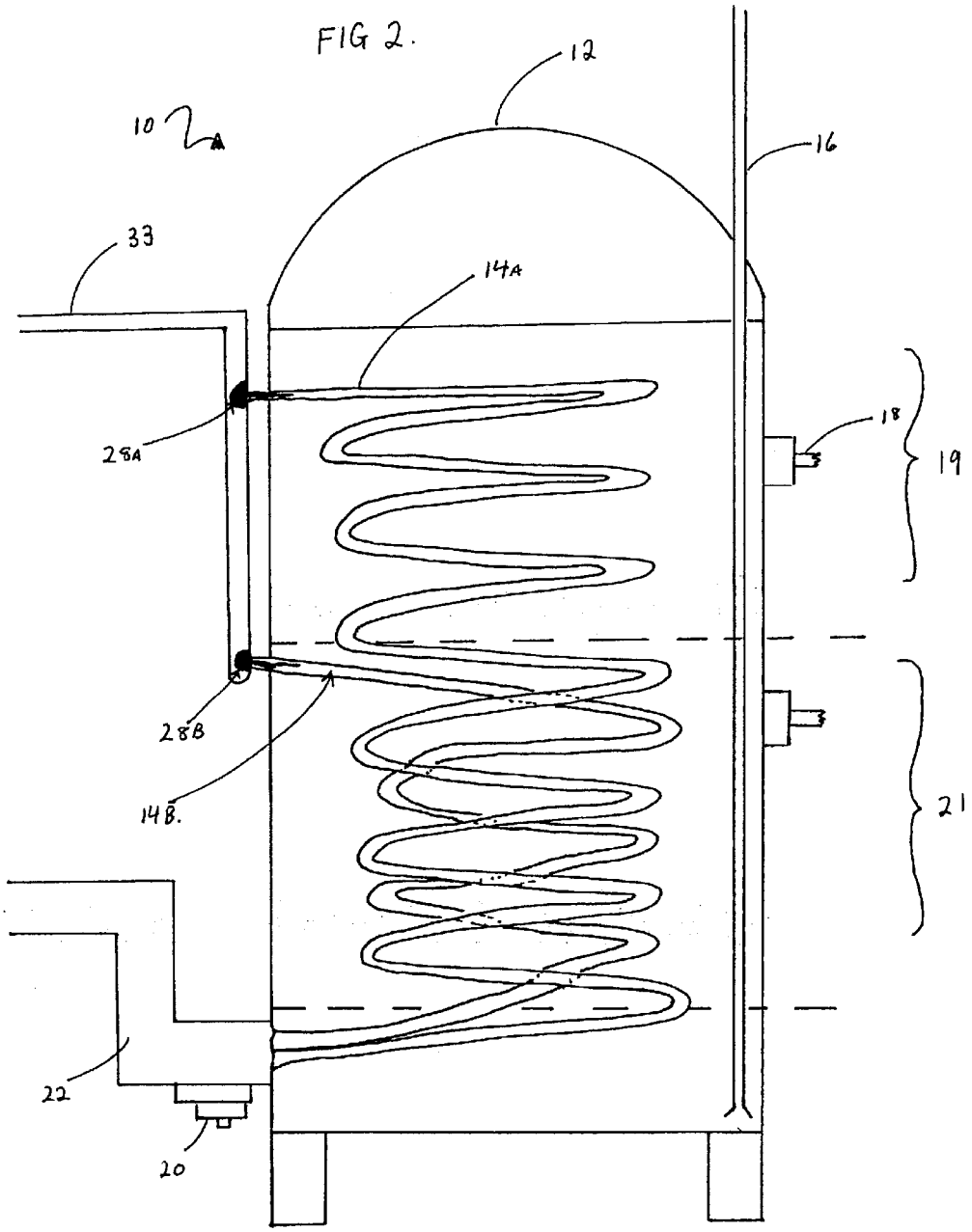
FIG. 2 is a sectional side view of another embodiment of the apparatus.

As depicted in FIGS. 1 and 2 the apparatus (10) is comprised of a water storage tank (12) the interior of which is heated by at least two individual heating conduits (14A, 14B). The conduits (14A, 14B) enter the tank (12) at a first upper entry point (30), travel through the interior of the tank (12) and exit the tank (12) at a second exit point (32). As shown in FIG. 1, in a preferred embodiment the individual conduits (14A, 14B) enter the tank (12) at an upper first entry point (30), descend through the interior of the tank (12) and exit through the side of the tank (12) at a second lower exit point (32). The conduits (14A, 14B) are designed to be heat exchangers and are hollow to facilitate the passage of hot air through them. The conduits (14A, 14B) are preferably constructed of a heat conductive material to maximize the transfer of heat from warm air filled interior of the conduit (14A or 14B) to the water (34) surrounding the conduit (14) in the tank (12). The conduit (14) may be constructed from various metals, including copper or such other corrosion resistant suitable material as may be chosen by one skilled in the art. In a preferred embodiment the conduits (14A, 14B) are made from stainless steel.

The gases inside the conduits (14A, 14B) are heated by a gas burner located inside the conduit, hereinafter referred to as a "gas inshot burner" (28). As shown in FIG. 1, the upper inshot burner (28A) is located inside the upper conduit (14A) at a position immediately adjacent to the first entry point (30) but exterior to the tank (12). The gas inshot burner (28) is fed by an external gas supply (33). The lower inshot burner (28B) is located inside the lower conduit (14B) at a lower entry point. It is anticipated that one common external gas supply (33) could be utilized for all of the individual gas inshot burners (28) however, the apparatus (10) may also be constructed with independent gas supplies for each individual gas inshot burner (28).

Because the inshot burners (28A, 28B) are located within the conduits (14), the tank (12) is not exposed to the flame and therefore, unlike a conventional hot water heater, the tank (12) can be constructed from a variety of high efficiency insulating materials such as composite fiberglass.

The individual conduits (14A, 14B) are associated with individual heating zones, with the first conduit (14A) being associated with a first heating zone (19) and the second conduit (14B) being associated with a second heating zone (21). As shown in FIG. 1, the heating zones (19,21) are vertically stacked. In a preferred embodiment, the individual conduits (14A, 14B) enter the tank (12) at different heights allowing the conduits (14A, 14B) to occupy different vertical parcels of space within the tank (12) corresponding with the different heating zones. The conduits (14A, 14B) may be helically coiled within the tank (12) to maximize heat exchange efficiency however such suggestion is not intended to be limiting to the invention claimed herein.

As shown in FIG. 1, in one embodiment the coils of the individual conduits (14A, 14B) will not overlap. However, as shown in FIG. 2, in an alternative embodiment however the coils of the individual conduits (14A, 14B) may overlap and fit together such that more than one individual conduit (14) may be associated with each heating zone.

The use of the individually heated conduits (14A, 14B) permits the creation of different heating zones (19,21) within the tank. The number of different heating zones that can be created is equal to the number of individual conduits used. The individual inshot gas burners (28A, 28B) are turned on or off as is required to maintain a constant temperature within the differential temperature zones. As depicted in FIG. 1, one method of regulating the inshot burners (28A, 28B) may be the use of aquastats (26) strategically placed on the interior surface of the tank (12). Each heating zone has a corresponding hot water outlet (18) to facilitate the removal of hot water of the specific temperature associated with that temperature zone. As hot water is removed, a cold-water inlet (16) feeds new cold water into the bottom of the tank (12) to maintain the water level within the tank (12).

The conduits exit the tank (12) at a second exit point (32). FIG. 1 shows a preferred embodiment whereby the conduits (14A, 14B) may exit the tank (12) at the same point and feed into a common exhaust flue (22) that carries the exhaust from the conduits (14A, 14B) to the exterior of the building containing the tank (12). In a further embodiment, the exhaust flue (22) may have an associated trap and drain assembly (20) to collect and remove condensation in the exhaust. An internal fan (24) may also be mounted in the exhaust flue (22) to draw the exhaust gases through the conduits (14A, 14B).

The inshot burners produce water vapor and corrosive gases as normal products of combustion. Therefore, the conduits and exhaust flue should preferably be constructed of stainless steel or other heat and corrosion-resistant material. As well, it is preferred that no portion of the conduit between the burner and the exit point from the tank be inclined upwards. This permits condensation to collect at the exit point and not be trapped within the conduit at any point within the tank.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A water heating apparatus comprising:

(a)a water storage tank having a cold water inlet and having at least two hot water outlets;

(b)at least two hollow heating conduits, each conduit passing into the tank from an exterior position, traveling through the interior of the tank and exiting out of the tank, wherein a first conduit is associated with a first heating zone and a second conduit is associated with a second heating zone, the heating zones being vertically stacked;

(c)each conduit having an inshot gas burner associated with the hollow conduit;

and (d)means for independently turning each inshot gas burner on or off.

2. The water heating apparatus of claim 1 wherein said conduits are helically coiled within the interior of the tank.

3. The apparatus of claim 2 wherein the first heating conduit is helically coiled within the first and second heating zones and the second heating conduit is helically coiled within the second heating zone only.

4. The apparatus of claim 2 wherein a number of the helical coils of the conduits overlap and fit between each other such that there may be more than one individual conduit associated with each heating zone.

5. The water heating apparatus of claim 1 wherein no portion of the conduits is inclined upwards.

6. The water heating apparatus of claim 1 wherein each means for independently turning each inshot gas burner on or off comprises an aquastat.

7. The water heating apparatus of claim 1 wherein the tank has a water outlet proximate to each heating zone.

8. The water heating apparatus of claim 1 wherein the individual conduits feed into a common exhaust flue at a common exit position.

9. The water heating apparatus of claim 8 wherein the common exhaust flue has an associated water trap and drain to remove condensation from exhaust gases produced by the inshot gas burners.

10. The water heating apparatus of claim 8 further comprising a fan associated with the common exhaust flue to draw the exhaust gases through the conduits.

11. The apparatus of claim 1 wherein the heating conduits each enter the tank at a different level and each exit the tank at substantially the same level.

12. The apparatus of claim 1 wherein each heating conduit enters the tank and exits the tank within the heating zone associated with that heating conduit.

* * * * *